US005289832A

United States Patent [19]

Funcell et al.

[11] Patent Number: 5,289,832

[45] Date of Patent: Mar. 1, 1994

[54] SMOKELESS ASHTRAY FOR TEMPORARY RETENTION AND/OR EXTINGUISHMENT OF CIGARETTES

[76] Inventors: Stanley D. Funcell; Doris C. Trogdon, both of 310 Bolin Forest Rd., Carrboro, N.C. 27510

[21] Appl. No.: 27,033

[22] Filed: Mar. 5, 1993

Related U.S. Application Data

[63] Continuation-in-part of Ser. No. 848,714, Mar. 9, 1992.

[51] Int. Cl.[5] ..... A24F 19/00; A24F 19/14

[52] U.S. Cl. ..... 131/241; 131/235.1; 131/240.1

[58] Field of Search ..... 131/231, 235.1, 240.1, 131/241, 256; D27/102, 183

[56] References Cited

U.S. PATENT DOCUMENTS

| | | | |
|---|---|---|---|
| 1,989,354 | 1/1935 | Fowler | 131/240.1 |
| 2,111,172 | 3/1938 | Cook | 131/240.1 X |
| 2,404,174 | 7/1946 | Hines | 131/235.1 |
| 3,675,662 | 7/1972 | Askins | 131/235.1 |
| 4,241,742 | 12/1980 | Hilding | 131/240.1 X |
| 4,856,537 | 8/1989 | Liu | 131/235.1 X |
| 5,020,549 | 6/1991 | Wojcik | 131/256 X |

FOREIGN PATENT DOCUMENTS

| | | | |
|---|---|---|---|
| 1262303 | 4/1961 | France | 131/235.1 |

*Primary Examiner*—V. Millin
*Assistant Examiner*—Jennifer Doyle
*Attorney, Agent, or Firm*—Richard E. Jenkins

[57] ABSTRACT

A smokeless ashtray adapted for both temporary retention as well as extinguishment of lighted cigarettes. The ashtray includes a base having an ash-receiving cavity recess therein. At least one inwardly inclined cigarette-receiving channel is provided within the base and includes a first lower end communicating with the ash-receiving cavity (or, in the alternative, being a closed end) and a second upper end communicating with an exterior wall of the ashtray base. The channel further includes a rib extending along the length of the bottom surface thereof and an outwardly extending shoulder adjacent the top of each side of the channel which extends generally below and parallel to the top of the exterior base wall so as to expose an increasingly greater surface area of the cigarette along the length thereof extending from the lowermost lit end to the uppermost unlit end to facilitate continuous smokeless burning as the ash portion of the cigarette increases in length.

4 Claims, 4 Drawing Sheets

SMOKELESS ASHTRAY FOR TEMPORARY RETENTION AND/OR EXTINGUISHMENT OF CIGARETTES

RELATED APPLICATION

This is a continuation-in-part application of Ser. No. 07/848,714 filed on Mar. 9, 1992 still pending for "Smokeless Ashtray for Temporary Retention and/or Extinguishment of Cigarettes".

FIELD OF THE INVENTION

The invention relates generally to smokeless ashtrays, and more particularly to a new and improved ashtray for temporarily retaining and/or extinguishing cigarettes while significantly reducing the amount of smoke produced by the cigarette.

RELATED ART

Many efforts have been made to develop a commercially successful and highly practical smokeless ashtray capable of keeping a cigarette lit but not significantly smoking during the time that a cigarette is placed therein during intermittent smoking thereof. Representative patent related to efforts to develop a smokeless ashtray include U.S. Pat. No. 4,982,746 to Pruyne and U.S. Pat. No. 5,020,549 to Wojcik. However, applicant does not believe that any of the previously developed smokeless ashtrays have proven themselves entirely successful in performing their intended function. Shortcomings of the prior art smokeless ashtrays are numerous and would be well known to one skilled in the ashtray design art.

For example, applicant believes that the smokeless ashtray disclosed in the aforementioned U.S. Pat. No. 5,020,549 tends to be somewhat impractical due to problems posed by the recessed groove defined in the bottom of each cigarette-retaining channel provided by the ashtray. As the groove becomes filled with cigarette ash, the ashtray becomes unsightly and the purported combustion chamber effect is diminished. Similarly, the ashtray disclosed in U.S. Pat. No. 4,982,746 suffers shortcomings in that there is a tendency of a lit cigarette resting in the channel therein to become extinguished in a relatively short time as the ash portion thereof increases in size relative to the length of the cigarette. Other prior art smokeless ashtrays known in the art are too complex for practical use and are easily broken or require the purchase of replacement batteries, filters and other replacement components.

DISCLOSURE OF THE INVENTION

In accordance with the present invention, applicant provides a smokeless ashtray designed specifically to minimize ambient smoke produced by a cigarette temporarily resting in the ashtray as well as a cigarette which is placed into the ashtray for extinguishment. The novel ashtray comprises a base defining an ash-receiving cavity recessed therein and having an exterior wall. One or more cigarette-receiving channels are defined within the base wherein a first end of the channel communicates with the ash-receiving cavity (or, in an alternative embodiment, is closed) and a second end communicates with the exterior wall of the base, and the channel depth decreases along the length thereof from the interior first end to the exterior second end thereof. The cigarette-receiving channel of the ashtray further has a rib extending along the length of the bottom surface thereof and a pair of outwardly extending ledges or shoulders wherein each shoulder is adjacent the top of a respective side of the channel and extends generally below and parallel to the top of the exterior wall of the base. Thus, the channel configuration provides for a lit cigarette positioned therein to have an increasingly greater surface area exposed along the length thereof extending from the lowermost lit end to the uppermost unlit end so as to facilitate continuous smokeless burning a the ash portion of the cigarette increases in length. It is therefore the object of the present invention to provide an improved smokeless ashtray for providing a smokeless rest for a lit cigarette not being smoked as well as a closed end aperture into which a cigarette may be positioned for smokeless extinguishment without damaging the burned end thereof.

It is another object of the present invention to provide an improved smokeless ashtray having a novel cigarette resting channel which provides proportionately increased cigarette surface area from the lit end to the unlit end thereof so as to facilitate the continued burning of the resting cigarette as the ash portion thereof increases in size relative to the cigarette length.

It is still another object of the present invention to provide an improved smokeless ashtray which may be easily cleaned and which does not require tedious removal of cigarette ashes from recesses or crevices therein.

Some of the objects of the invention having been stated, other objects will become evident as the description proceeds, when taken in connection with the drawings described in detail below.

BEST MODE FOR CARRYING OUT THE INVENTION

Figure 1:
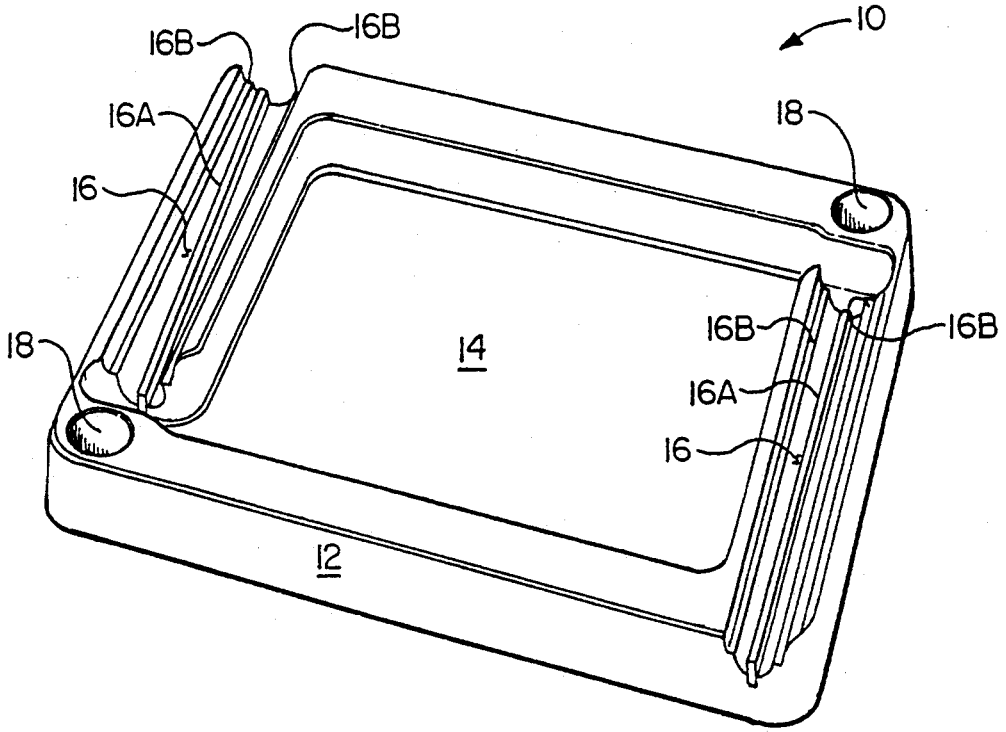
FIG. 1 is a perspective view of an ashtray incorporating the features of the present invention.

Referring now to FIGS. 1-6 of the drawings, an ashtray generally designated 10 and incorporating the features of the present invention is illustrated. Ashtray 10 comprises a housing or base 12 which may be formed from ceramic, plastic, metal or other suitable material. Base 12 defines an ash-receiving cavity 14 in the medial portion thereof for receiving ashes from the burning ends of cigarettes as well as cigarette butts from fully burned cigarettes. Base 12 further defines two channels 16 therein for receiving a lit cigarette which is to be rested in ashtray 10 during continuous smoking of the cigarette. Also, ashtray 10 includes two close-ended apertures 18 therein for snugly receiving a lit cigarette and quickly extinguishing the cigarette without damaging the burned end thereof. This allows for relighting and continued smoking of the cigarette at another time.

Both apertures 18 and channels 16 are configured so as to minimize the rate of burning and thus the smoke which would otherwise be emitted by a cigarette into the ambient environment of ashtray 10. In this fashion, ashtray 10 provides a highly desirable ashtray for use by a cigarette smoker with minimum introduction of cigarette smoke into the environment of the ashtray. Moreover, the design of ashtray 10, particularly lit cigarette-receiving channels 16, lends itself particularly well to ease of cleaning and improved aesthetics for an ashtray of the smokeless type.

Figure 2:
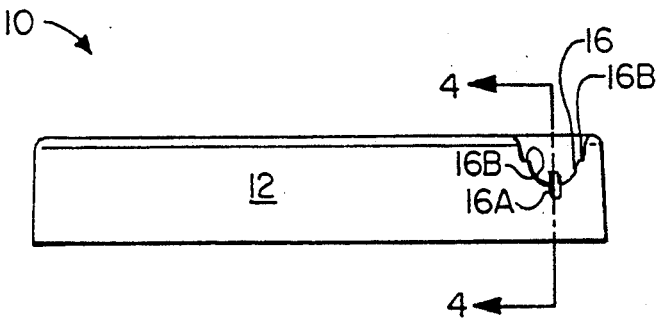
FIG. 2 is a front elevation view of an ashtray incorporating the features of the present invention.
Figure 3:
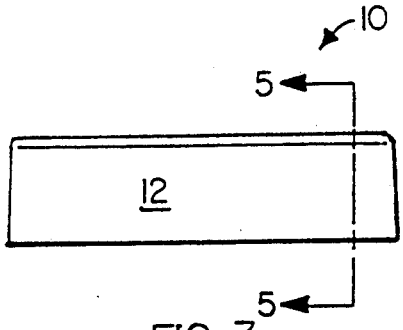
FIG. 3 is an end view of an ashtray incorporating the features of the present invention.
Figure 4:
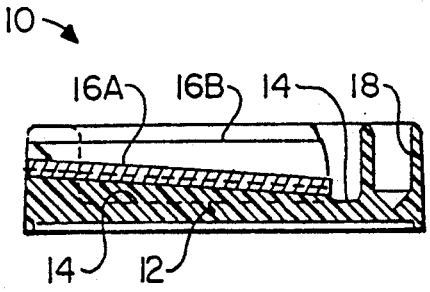
FIG. 4 is a vertical section view taken on the line 4—4 of FIG. 2.

Referring now more specifically to channels 16 of ashtray 10, applicant wishes to describe their unique construction which facilitates relatively smokeless and continuous burning (up to about three minutes or so) of a lit cigarette rested therein by the user during the smoking of the cigarette. FIGS. 2, and 4 are particularly helpful in appreciating that channels 16 are formed with a substantially semi-circular, concave shape and have a decreasing height from the inner end thereof (which communicates with ash-receiving cavity 14) and the outer end thereof (which communicates with an exterior wall of base 12). A rib 16A is provided substantially at the bottom of each channel 16 and extends along at least a portion of the length thereof so as to space a cigarette positioned thereon apart from the bottom surface of each channel 16. Also, each channel 16 includes a pair of shoulders 16B adjacent the top of the channel and extending generally parallel to the top wall of base 12.

Figure 5:
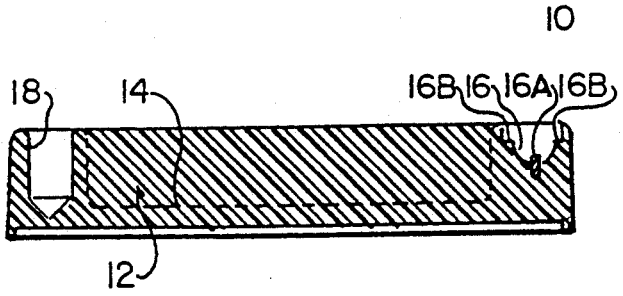
FIG. 5 is a vertical section view taken on the line 5—5 of FIG. 3.
Figure 6A:
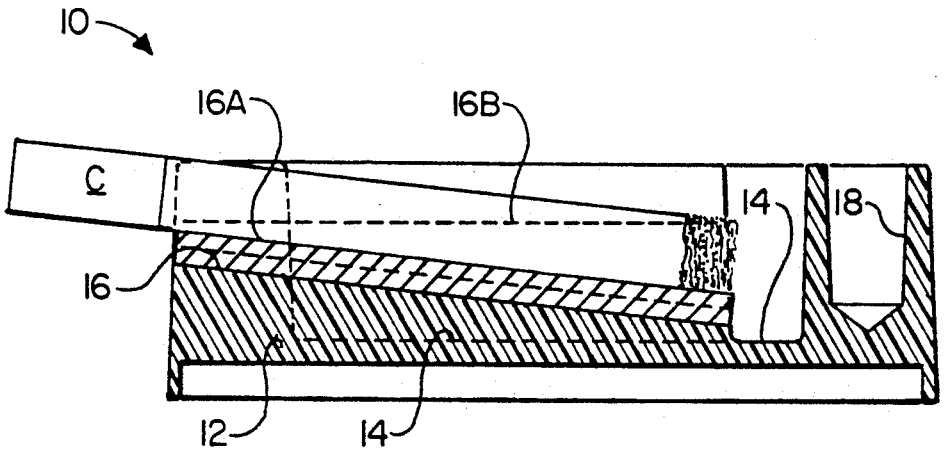
FIG. 6A is a vertical section view similar to FIG. 4 but illustrating a newly lit cigarette resting in a channel of the ashtray.
Figure 6B:
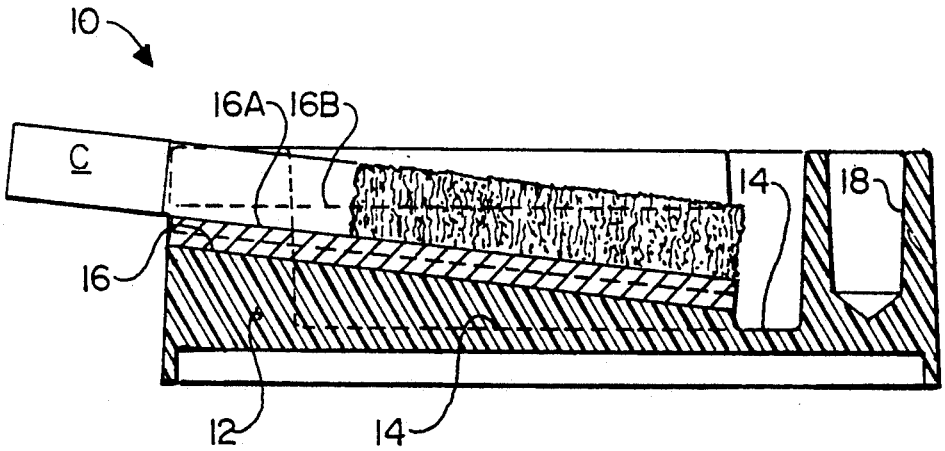
FIG. 6B is a view similar to FIG. 6A but with the cigarette having substantially burned and the ash portion thereof representing a greater portion of the cigarette length.
Figure 6C:
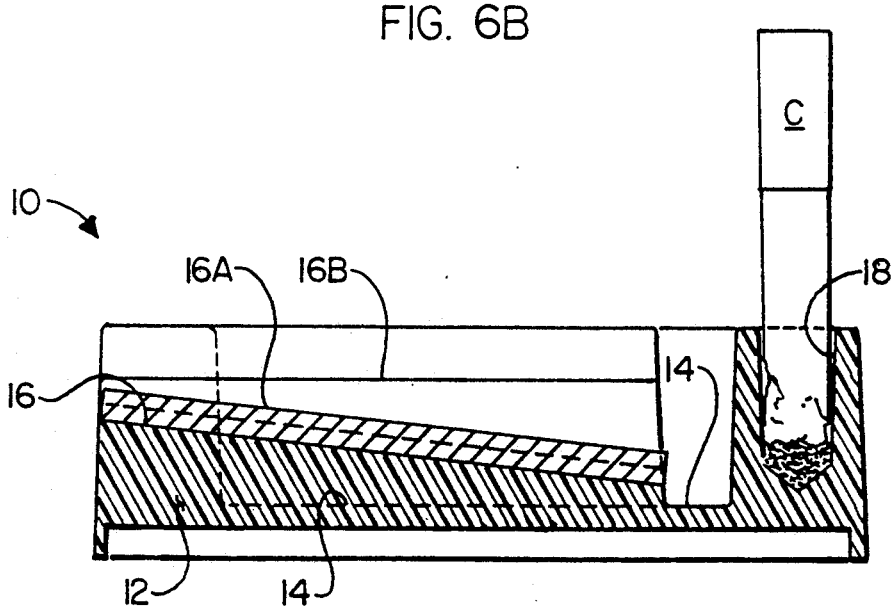
FIG. 6C is a view similar to FIGS. 6A and 6B but with a cigarette positioned in a closed end aperture for smokeless extinguishment without damaging the burned end thereof.

Ashtray 10 also includes the aforementioned closed end apertures is for extinguishing a cigarette inserted therein within about five seconds without crushing the burned end in order to allow for relighting and continued smoking at a later time. Apertures 18 are positioned at diagonally opposing corners of base 12 and spaced-apart from the innermost ends of channels 16. As best seen in FIGS. 4–6, apertures 18 are each formed with a first portion having a diameter only slightly larger than cigarette C so as to snugly receive the lighted end of cigarette C therein (see FIG. 6C). The bottom portions of apertures 18 are concave or conically shaped so as to define an air compartment which essentially performs two functions. Firstly, the concave or tapered end of each aperture 18 serves as a closed air chamber when cigarette C is inserted into an aperture 18 so that cigarette C will burn for a short period and then g out due to lack of oxygen. The extinguishment of cigarette C by an aperture 18 is substantially smokeless and does not damage the burned end of cigarette C. Secondly, the downwardly tapered shape of the closed end of each aperture 18 serves as a reservoir for catching any ash falling from the burned end of cigarette C and prevents the burned ash from being forced into the burned end of cigarette C. Otherwise, the taste of cigarette C could be unpleasant when removed and relit. The concave or conically tapered closed ends of apertures 18 are also advantageous since, like aforementioned channels 16, they lend themselves particularly well to ease of cleaning in order to maintain the aesthetics and functionality of ashtray 10.

In use, when cigarette C is first lit and initially rested in one of channels 16 of ashtray 10 (see FIG. 6A), the lowermost inner end of the channel is open so as to allow for fluid communication of the lit end with the air in ash-receiving cavity 14. Thus, oxygen is provided to the cigarette predominantly from the open end of the channel and secondarily from above and beneath the cigarette. As cigarette C is smoked, an ash build-up occurs and creates an insulation block between the hot part of the lit end and the opening of channel 16 to ash-receiving cavity 14 (see FIG. 6B). Due to the aforementioned insulation block, cigarette C requires more oxygen in order to remain lit, and additional oxygen is provided from above cigarette C since the lower end of cigarette C is elevated in height above shoulders 16B adjacent the top of channel 16. In view of the fact that shoulders 16B are parallel to the top of base 12 and not parallel to the bottom of channel 16, the elevation of the bottom end of cigarette C allows more surface area to be exposed and more oxygen to be available to the hot part of cigarette C (see FIG. 6B). This feature is particularly advantageous and provides surprising and unexpected efficacy to the performance of smokeless ashtray 10.

Applicant believes that since channels 16 are designed so that oxygen is supplied to the lit portion of cigarette C in more than one place (e.g., the top, both the left side shoulder and the right side shoulder, and the bottom right and bottom left) cigarette C is allowed to have more than one hot spot. By providing for more than one hot spot in cigarette C while positioned in one of channels 16, the smoker advantageously does not have to take hard drags to make cigarette C hot enough to smoke once it is removed from channel 16.

Applicant wishes to observe that although ashtray 10 is shown in the illustrations as having a four-sided rectangular base 12 with a cigarette-receiving channel 16 provided at each end thereof extending parallel to a respective exterior end wall, other embodiments of the ashtray are contemplated as within the scope of the invention. Moreover, the provision of two cigarette extinguishing apertures 18 as shown in the drawings wherein the apertures are provided at diagonally opposing corners of ashtray 10 is also merely one embodiment of the present invention. Thus, applicant contemplates that ashtray 10 could be formed with one or more channels 16 and one or more apertures 18 and could be formed in substantially any shape such as round, rectangular or square. The shape of ashtray base 12 and the number of channels 16 and/or apertures 18 are a matter of design choice and the present invention is not intended to be limited by the preferred embodiment described and shown herein.

ALTERNATIVE EMBODIMENT

Figure 7:
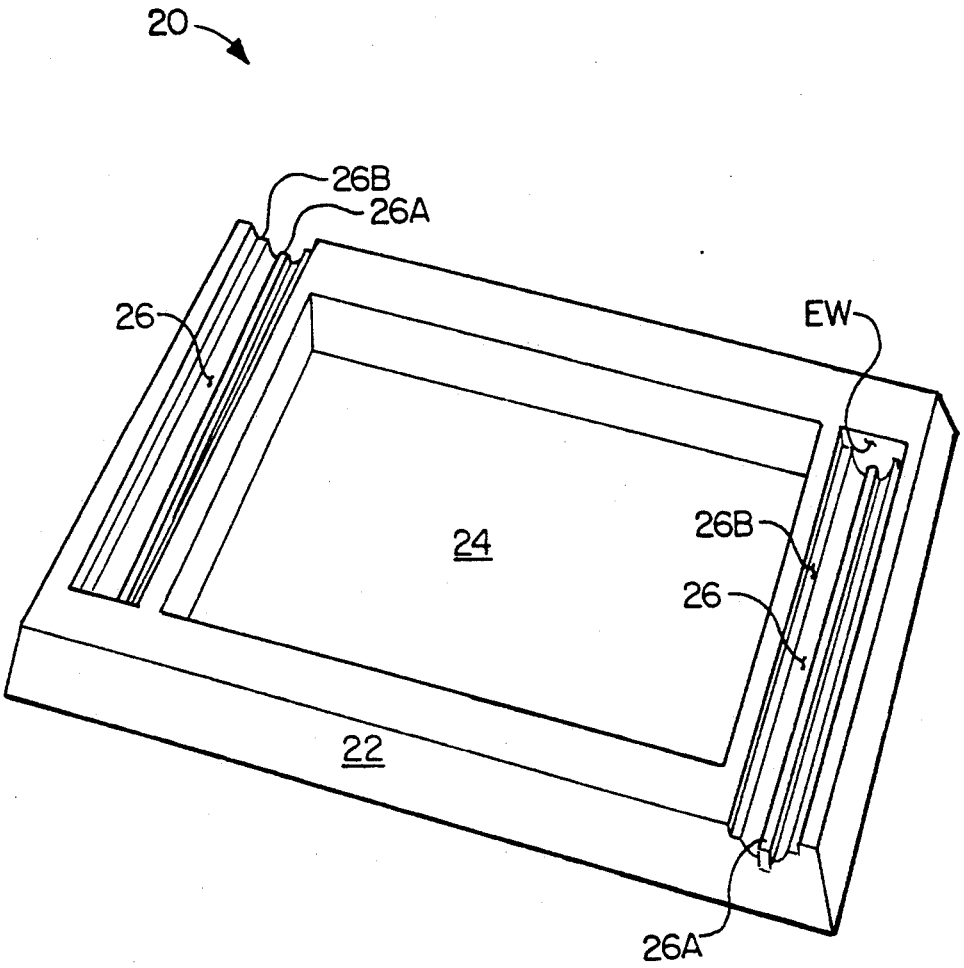
FIG. 7 is a perspective view of an alternative embodiment of an ashtray incorporating the features of the present invention.
Figure 9:
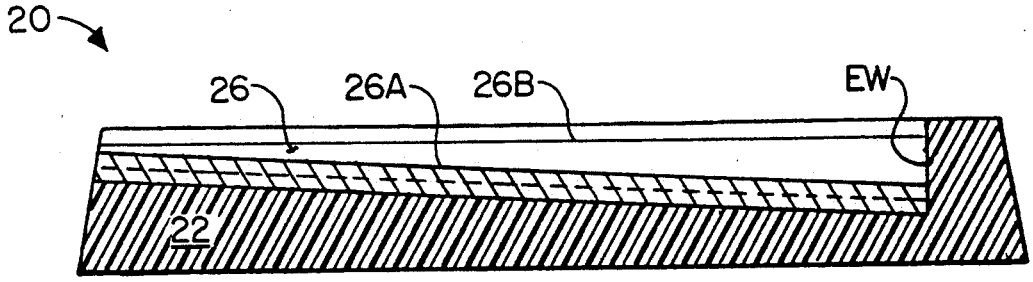
FIG. 9 is a verticle section view taken on the line 9—9 of FIG. 8.
Figure 8:
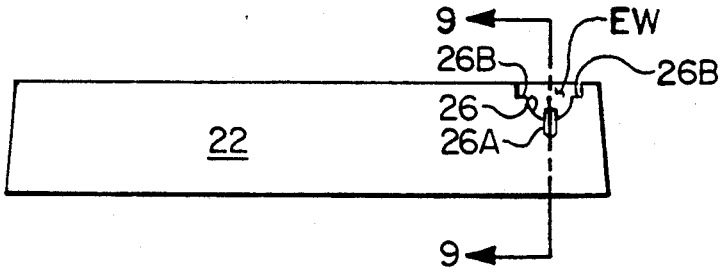
FIG. 8 is a front elevation view of the ashtray shown in FIG. 7.

Referring now to FIGS. 7–9 of the drawings, an alternative embodiment of the ashtray of the invention is shown and generally designated 20. Ashtray 20 comprises a housing or base 22 which may be formed from ceramic, plastic, metal or other suitable material. Base 22 defines an ash-receiving cavity 24 in the medial portion thereof for receiving ashes from the burning ends of cigarettes as well as cigarette butts from fully burned cigarettes. Base 22 further defines two channels 2 therein for receiving a lit cigarette which is to be rested on ashtray 20 during continuous smoking of the cigarette.

With reference now specifically to channels 26 of ashtray 20, applicant desires to note that the unique construction of channels 26 facilitates relatively smokeless and continuous burning for up to about three minutes or so of a lit cigarette rested therein by the user during smoking of the cigarette. As shown in FIGS. 7–9, channels 26 are formed with a substantially semicircular, concave shape and have a continuously decreasing height from the inner end of the channel (which abuts end wall EW so as to close the channel) and the outer end thereof (which communicates with an exterior wall of base 22). A rib 26A is provided substantially at the bottom of each channel 26 and extends along at least a portion of the length thereof so as to space a cigarette positioned thereon slightly above the bottom surface of each channel 26. Furthermore, each channel 26 includes a pair of shoulders 26B adjacent the top of the channel and which extend generally parallel to the top wall of base 22.

In use, when a cigarette is first lit and initially rested in one of channels 26 of ashtray 20, oxygen is provided to the cigarette from above and beneath due to the construction of channel 26. As the cigarette resides in channel 26, an ash buildup will occur which tends to deprive the lit end of the cigarette of oxygen. However, additionaly oxygen is provided to the cigarette in view of the fact that shoulders 26B are parallel to the top of base 22 and not parallel to the bottom of channel 26 so as to elevate the bottom end of the cigarette and allow for more surface area to be exposed and more oxygen to be made available to the hot part of the cigarette. This feature is particularly advantageous and allows for a cigarette positioned in ashtray 20 to remain lit for an unexpected and surprisingly long period o time.

Finally, applicant wishes to note that although ashtray 20 is shown in FIGS. 7–9 as having a four-sided rectangular base 22 with a cigarette-receiving channel 26 provided at each end thereof, other embodiments of the ashtray are contemplated as being within the scope of the invention, including but not limited to a four-channel embodiment wherein each cigarette-receiving channel extends parallel to a respective exterior end wall of a rectangular base. Furthermore, the shape of ashtray base 22 and the number of channels 26 are a matter of design choice, as in the first embodiment of the invention described in detail above.

It will be understood that various details of the invention may be changed without departing from the scope of the invention. Furthermore, the foregoing description is for the purpose of illustration only, and not for the purpose of limitation—the invention being defined by the claims.

We claim:

1. A smokeless ashtray comprising:

a base defining an ash-receiving cavity recessed therein and an exterior wall;

at least one cigarette-receiving channel defined within said base wherein a first end of said channel is closed and a second end communicates with said exterior wall of said base, said channel having a depth which decreases along the length thereof from said first closed end to said second open end;

said cigarette-receiving channel having a rib extending along at least a portion of the length of the bottom surface thereof and an outwardly extending ledge or shoulder adjacent the top of each side of said channel, said shoulders extending generally below and parallel to the top of said exterior wall of said base and said shoulders defining a depth relative to said channel which decreases along the length of said channel from said first end to said second end thereof;

whereby a lit cigarette positioned in said channel will have an increasingly greater surface area exposed along the length thereof extending from said lowermost lit end to the unlit end thereof to facilitate continuous smokeless burning as the ash portion of the cigarette increases in length.

2. An ashtray according to claim 1 wherein said base comprises a generally rectangular shape having four exterior walls.

3. An ashtray according to claim 1 wherein said at least one cigarette-receiving channel comprises two cigarette-receiving channels.

4. An ashtray according to claim 3 wherein said base defines at least two opposing exterior walls are said two cigarette-receiving channels each extend generally parallel in the lengthwise direction to a respective one of said two opposing exterior walls of said base.

* * * * *